US011506163B2

(12) United States Patent
Mahmood et al.

(10) Patent No.: US 11,506,163 B2
(45) Date of Patent: Nov. 22, 2022

(54) TWO-PIECE OUTLET CHECK IN FUEL INJECTOR FOR STARTING-FLOW RATE SHAPING

(71) Applicant: Caterpillar Inc., Peoria, IL (US)

(72) Inventors: Sana Mahmood, Albuquerque, NM (US); Glenn Brian Cox, Peoria, IL (US); Dana Ray Coldren, Secor, IL (US)

(73) Assignee: Caterpillar Inc., Peoria, IL (US)

( * ) Notice: Subject to any disclaimer, the term of this patent is extended or adjusted under 35 U.S.C. 154(b) by 38 days.

(21) Appl. No.: 17/121,352

(22) Filed: Dec. 14, 2020

(65) Prior Publication Data

US 2022/0186697 A1 Jun. 16, 2022

(51) Int. Cl.
*F02M 61/18* (2006.01)
*F02M 63/00* (2006.01)

(52) U.S. Cl.
CPC ..... *F02M 61/182* (2013.01); *F02M 61/1886* (2013.01); *F02M 63/0054* (2013.01); *F02M 63/0077* (2013.01)

(58) Field of Classification Search
CPC ..... F02M 61/182; F02M 61/1886; F02M 61/0054; F02M 61/0077
USPC ..... 239/533.12, 533.7, 533.11, 533.14
See application file for complete search history.

(56) References Cited

U.S. PATENT DOCUMENTS 3,391,871 A * 7/1968 Fleischer ..... F02M 45/08 239/584
6,102,299 A * 8/2000 Pace ..... F02M 61/16 239/596
6,412,705 B1 7/2002 Desai et al.
6,776,353 B2 * 8/2004 Moorthy ..... F02M 61/18 239/596
6,843,434 B2 * 1/2005 Lawrence ..... F02M 59/366 239/585.5
6,886,762 B2 * 5/2005 Angelino ..... F02B 1/12 251/360
6,935,580 B2 8/2005 Azam et al.
7,082,921 B2 * 8/2006 Shimizu ..... F02M 61/162 123/472
8,893,989 B2 * 11/2014 Mueller ..... F02M 61/1893 239/533.13
2011/0048379 A1 3/2011 Sommars et al.
2011/0232601 A1 9/2011 Kim

FOREIGN PATENT DOCUMENTS

DE 19631066 A1 * 2/1998 ..... F02M 51/0653

* cited by examiner

*Primary Examiner* — Mahmoud Gimie
(74) *Attorney, Agent, or Firm* — Brannon Sowers & Cracraft PC

(57) ABSTRACT

A fuel injector nozzle assembly includes a two-piece outlet check having a timing control piece and a rate control piece. A nozzle passage is formed between a nozzle body and a two-piece outlet check, and a sac cavity is formed by the rate control piece and the nozzle body and fluidly connects a through-hole in the rate control piece to nozzle outlets. A starting-flow clearance is formed by the rate control piece and the timing control piece, and is opened by moving the timing control piece relative to the rate control piece. Moving the rate control piece relative to the nozzle body opens a main-flow seat. The nozzle assembly provides a slow starting injection rate shape in a common rail or similar fuel system and improved controllability over minimum delivery quantities.

20 Claims, 5 Drawing Sheets

TWO-PIECE OUTLET CHECK IN FUEL INJECTOR FOR STARTING-FLOW RATE SHAPING

TECHNICAL FIELD

The present disclosure relates generally to a fuel injector, and more particularly to a nozzle assembly in a fuel injector having a two-piece outlet check with a timing control piece and a separate rate control piece together forming a starting-flow clearance.

BACKGROUND

In recent decades, emissions requirements for internal combustion engines have become increasingly stringent. Engine manufacturers and components suppliers continue to seek strategies for reducing undesired emissions such as particulate matter and oxides of nitrogen or "NOx". Various strategies are known for reducing such emissions in engine exhaust aftertreatment systems, as well as strategies for limiting production of such emissions in the combustion process itself. Most modern internal combustion engine systems employ a combination of strategies for limiting production of emissions as well as trapping or treating emissions that are still invariably produced.

Common targets for promoting a reduction in the production of certain emissions are the process and parameters of fuel delivery into an engine cylinder, notably direct fuel injection in the case of compression-ignition diesel engines. A variety of well-known techniques employ a pressurized reservoir of fuel, conventionally referred to as a common rail, that makes fuel available for injection at a desired injection pressure, and also for actuating various of the moving components within the fuel injectors. Common rail and related strategies have enabled engineers to develop systems that can control fuel injection timing, amount, and rate shape with relatively great precision, but still experience various limitations. It has been observed that optimal operation and performance can be at least theoretically be achieved in certain applications where relatively small quantities of fuel can be precisely injected. Other, and similar, performance benefits are expected where a starting rate shape of fuel injection is precisely controlled. Front-end rate shaping and precisely controlled tiny fuel injection amounts in common rail fuel systems have nevertheless proven challenging goals to achieve. One known common rail fuel injection system is known from United States Patent Application Publication No. 2011/0048379 to Sommars et al. Sommars et al. propose a fluid injector with rate shaping capability where a check speed control device is disposed between first and second check control chambers in a cavity. Control valves and the check speed control device control the speed of a check by controlling flows of fuel out of the control chambers. While Sommars et al. set forth a strategy likely having certain applications, there is always room for improvement and development of alternative strategies.

SUMMARY OF THE INVENTION

In one aspect, a fuel injector includes a nozzle body defining a longitudinal axis, and having nozzle outlets formed therein each extending between an outer nozzle surface and an inner nozzle surface. The fuel injector further includes a two-piece outlet check having a timing control piece, and a rate control piece trapped between the timing control piece and the nozzle body, and having a through-hole formed therein fluidly connected to the nozzle outlets. A nozzle passage is formed between the nozzle body and the two-piece outlet check, and a starting-flow clearance is formed by the rate control piece and the timing control piece and extends between the nozzle passage and the through-hole. The timing control piece is movable from an advanced position in contact with the rate control piece and blocking the starting-flow clearance, to a retracted position, relative to the rate control piece, where the starting-flow clearance is open. The rate control piece is movable, relative to the nozzle body and based on a position of the timing control piece, from an advanced position in contact with the inner nozzle surface, to a retracted position where a main-flow injection path is formed between the rate control piece and the nozzle body and fluidly connects the nozzle passage to the nozzle outlets.

In another aspect, a fuel injector nozzle assembly includes a nozzle body defining a longitudinal axis, and having a nozzle tip with nozzle outlets formed therein each extending between an outer nozzle surface and an inner nozzle surface. The fuel injector nozzle assembly further includes a two-piece outlet check positioned at least partially within the nozzle body and having a timing control piece, and a rate control piece trapped between the timing control piece and the nozzle body and having a tip-facing axial side, an opposite axial side, and a through-hole extending between the tip-facing axial side and the opposite axial side. A nozzle passage is formed between the nozzle body and the two-piece outlet check. A sac cavity is formed by the rate control piece and the nozzle body and fluidly connects the through-hole to the nozzle outlets. A starting-flow clearance is formed by the rate control piece and the timing control piece and extends between the nozzle passage and the through-hole. The timing control piece is movable from an advanced position in contact with the rate control piece and blocking the starting-flow clearance at a radially inward seating location, to a retracted position, relative to the rate control piece, where the starting-flow clearance is open. The inner nozzle surface forms a main-flow seat, and the rate control piece is movable, relative to the nozzle body and based on a position of the timing control piece, from an advanced position in contact with the inner nozzle surface at a radially outward seating location and blocking the main-flow seat, to a retracted position where the main-flow seat is open.

In still another aspect, a method of operating a fuel injector for an internal combustion engine includes retracting a timing control piece in a two-piece outlet check in a fuel injector, and opening a starting-flow clearance formed between the timing control piece and a rate control piece of the two-piece outlet check based on the retracting of the timing control piece. The method further includes conveying a starting flow of fuel through the starting-flow clearance to nozzle outlets in the fuel injector to start a spray of fuel from the fuel injector. The method further includes retracting the rate control piece after initiating the retracting of the timing control piece to open a main-flow seat, and conveying a main flow of the fuel through the main-flow seat to the nozzle outlets to continue the spray of fuel from the fuel injector.

DETAILED DESCRIPTION

Figure 1:
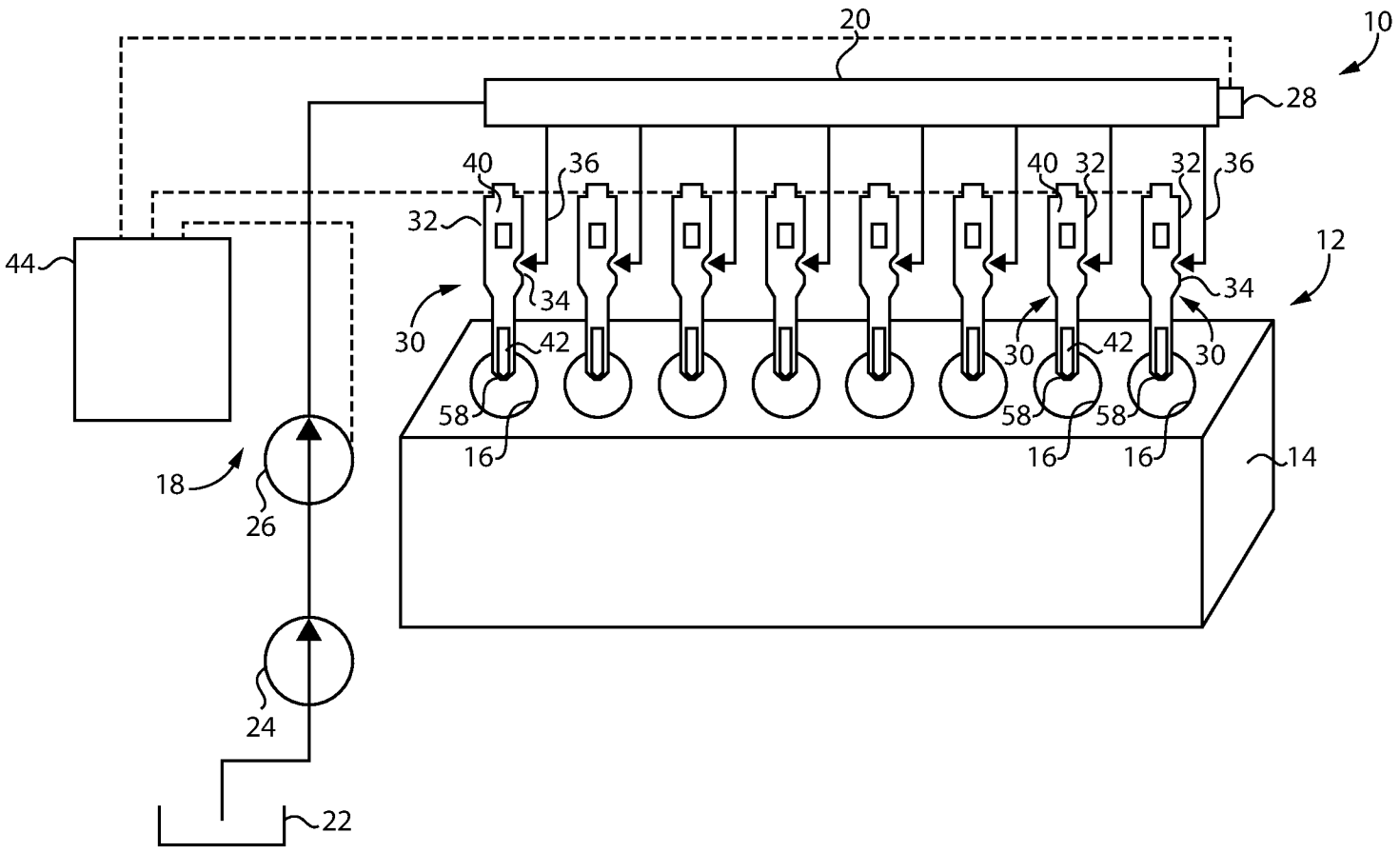
FIG. 1 is a diagrammatic view of an internal combustion engine system, according to one embodiment.

Referring to FIG. 1, there is shown an internal combustion engine system 10, according to one embodiment, and having an engine 12 with a cylinder block 14 having a plurality of combustion cylinders 16 formed therein. Internal combustion engine system 10 will be understood to also include an intake air system, an exhaust system and various other known types of equipment not specifically illustrated. Engine 12 can include any number of combustion cylinders in any suitable arrangement, such as an inline pattern, a V-pattern, or still another. Internal combustion engine system 10 also includes a pressurized fuel system 18 having a pressurized fuel reservoir 20, a fuel supply or fuel tank 22, a low pressure transfer pump 24, and a high pressure pump 26 together structured to supply and pressurize a liquid fuel to pressurized fuel reservoir 20 for injection. Internal combustion engine system 10 can include a compression-ignition diesel engine system operated on a suitable fuel such as a liquid diesel distillate fuel. Pressurized fuel reservoir 20 can include a so-called common rail or like apparatus structured to contain fuel at a desired pressure for delivery to a plurality of fuel injectors 30. Fuel injectors 30 may each be positioned to extend partially into one of combustion cylinders 16 for direct injection of fuel therein. Fuel system 18 also includes a plurality of high-pressure fuel connectors 36, such as so-called quill connectors, structured to convey pressurized fuel from pressurized fuel reservoir 20 to each of fuel injectors 30. Any suitable fuel pressurization, containment, or delivery configuration of fuel system 18 could be used within the context of the present disclosure. While a common rail strategy provides a practical implementation, embodiments are contemplated where unit pumps each associated with one fuel injector 30 are used. As will be further apparent from the following description, fuel injectors 30, hereinafter referred to in the singular, are structured for improved starting injection rate shape control and improved minimum delivery quantity control as compared to certain known systems.

Figure 2:
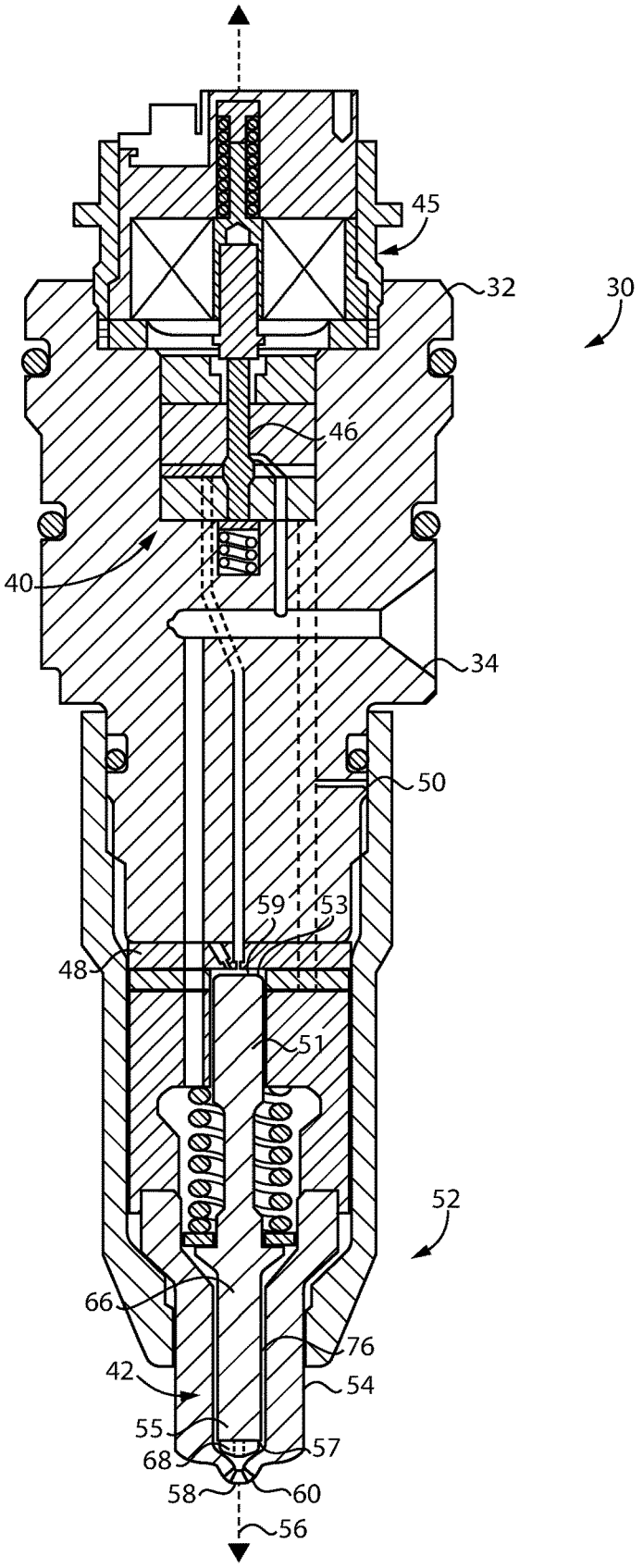
FIG. 2 is a sectioned side diagrammatic view of a fuel injector, according to one embodiment.

Referring also now to FIG. 2, fuel injector 30 includes an injector body or housing 32 having a high pressure fuel inlet 34 structured to receive a feed of pressurized fuel from a corresponding connector 36. Fuel injector 30 includes a tip 58 structured to extend into a combustion cylinder 16, and an electrically actuated injection control valve assembly 40. Fuel system 18 may also include an electronic control unit 44 in communication with injection control valve assembly 40, and also with high pressure pump 26. A pressure sensor 28 may be coupled with pressurized fuel reservoir 20, and is also in communication with electronic control unit 44 enabling electronic control unit 44 to maintain or controllably vary a pressure of fuel contained in pressurized fuel reservoir 20 in a generally known manner.

In the illustrated embodiment, injection control valve assembly 40 includes an electrical actuator 45, such as a solenoid electrical actuator, and a control valve 46. Control valve 46 may be of a known design, such as a two-position, three-way control valve, a two-position, two-way control valve, or still another valve type or valve assembly. Operation of control valve assembly 40 may be according to principals well-known in the art and is not hereinafter further described. An orifice plate 48 may be within fuel injector 30 and provides fluid connections between and among internal fluid passage structures in fuel injector 30, including high pressure fuel inlet 34 and a low pressure drain 50. A control chamber 59 is formed in fuel injector 30 and provides a control pressure that is varied to start fuel injection and end fuel injection, based on operation of control valve assembly 40.

Figure 3:
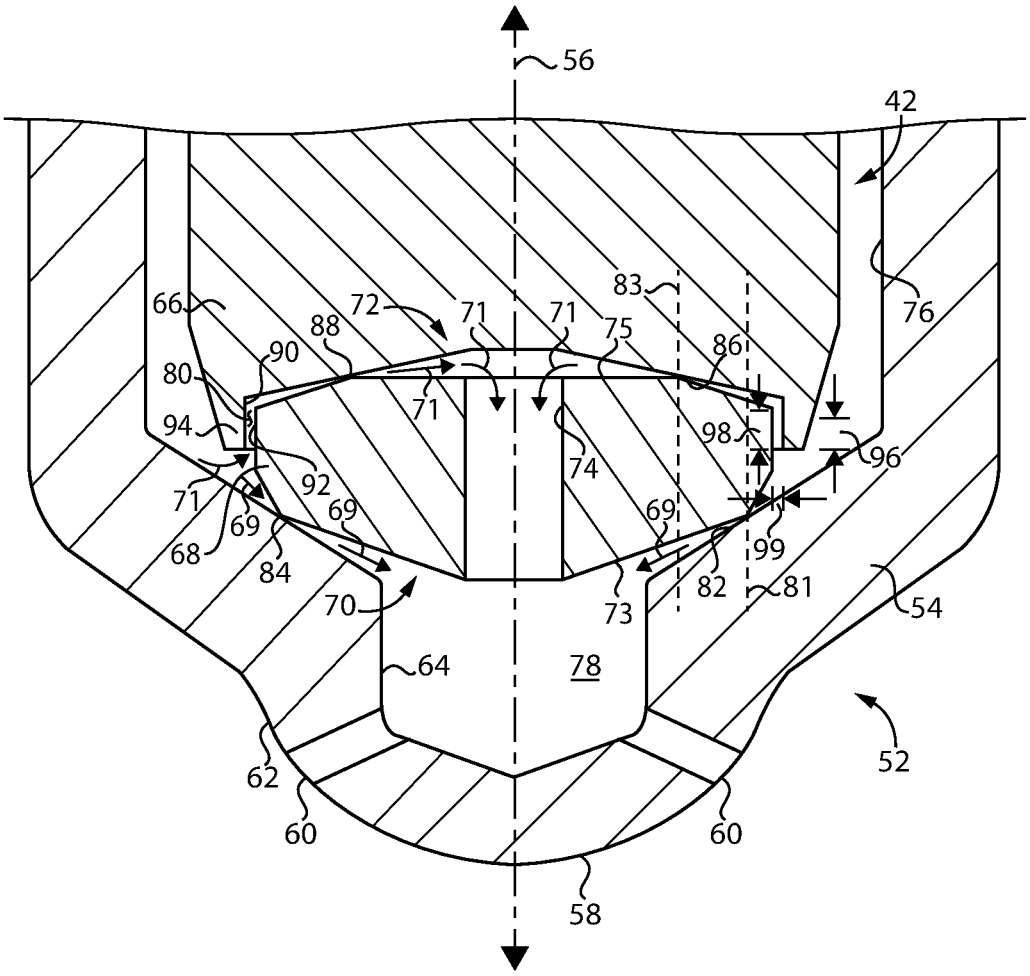
FIG. 3 is a sectioned side diagrammatic view of a fuel injector nozzle assembly, according to one embodiment.

Two-piece outlet check 42 includes a timing control piece 66, and a rate control piece 68. Timing control piece 66 includes a first axial end 51 having a closing hydraulic surface 53 formed thereon and exposed to a fluid pressure of control chamber 59. Timing control piece 66 further includes a second axial end 55 in contact, at times, with rate control piece 68, as further discussed herein. Referring also now to FIG. 3, fuel injector 30 further includes a fuel injector nozzle assembly 52 of which two-piece outlet check 42 may be considered a part. Nozzle assembly 52 includes a nozzle body 54 defining a longitudinal axis 56, and including a nozzle tip 58, the same feature as the above-mentioned injector tip 58. Nozzle tip 58 has a plurality of nozzle outlets 60 formed therein, each extending between an outer nozzle surface 62 and an inner nozzle surface 64. Two-piece outlet check 42 is positioned, at least partially, within nozzle body 54 and includes timing control piece 66 and rate control piece 68 as noted above. Timing control piece 68 is movable, in response to operation of control valve assembly 40, to start injection at a desired injection timing and to end injection at a desired ending timing. Rate control piece 68 is movable, based on movement and position of timing control piece 66, to provide a desired fuel injection front end or starting rate shape as further discussed herein. Rate control piece 68 is trapped between timing control piece 66 and nozzle body 54 and has a tip-facing axial side 70, an opposite axial side 72, and a through-hole 74 extending between tip-facing axial side 70 and opposite axial side 72. Through-hole 74 could be one of a plurality of through-holes in some embodiments. Timing control piece 66 may define a longer axial length dimension extending between first axial end 51 and second axial end 55, and rate control piece 68 may define a shorter axial length dimension extending between tip-facing axial side 70 and opposite axial side 72. A nozzle passage 76 is formed in fuel injector 30 between nozzle body 54 and two-piece outlet check 42. In the illustrated embodiment of FIG. 2, nozzle passage 76 extends from high pressure fuel inlet 34, and has various other branches or fluid connections to provide high pressure fuel to control valve assembly 40, to control chamber 59, and to nozzle outlets 60. As noted above, closing hydraulic surface 53 is exposed to a fluid pressure of control chamber 59. Second axial end 55 of timing control piece 66 has an opening hydraulic surface 57 formed thereon and exposed to a fluid pressure of nozzle passage 76. A sac cavity 78 is formed by rate control piece 68 and nozzle body 54 and fluidly connects through-hole 74 to nozzle outlets 60.

A starting-flow clearance 80 is formed by rate control piece 68 and timing control piece 66 and extends between nozzle passage 76 and through-hole 74. Timing control piece 66 is movable from an advanced position in contact with rate control piece 68 and blocking starting-flow clearance 80 at a radially inward seating location 81, to a retracted position, relative to rate control piece 68, where starting-flow clearance 80 is open. Inner nozzle surface 64 further forms a main-flow seat 82, and rate control piece 68 is movable, relative to nozzle body 54 and based on a position of timing control piece 66, from an advanced position in contact with inner nozzle surface 64 at a radially outward seating location 83 and blocking main-flow seat 82, to a retracted position where main-flow seat 82 is open.

It will thus be appreciated that timing control piece 66 can be retracted, with rate control piece 68 momentarily remaining at an advanced position blocking main-flow seat 82, to open starting-flow clearance 80, and initiate a flow of fuel from nozzle passage 42, though starting-flow clearance 80, through through-hole 74, to sac cavity 78 and then out of nozzle outlets 60. With timing control piece 66 still retracted, rate control piece 68 can then retract to open main-flow seat 82. In FIG. 3, arrows 71 show an approximate flow path of fuel from nozzle passage 42, through starting-flow clearance 80 when open, then through through-hole 74, and thenceforth into sac cavity 78 and out nozzle outlets 60. Arrows 69 illustrate an approximate main-flow injection path formed between rate control piece 68 and nozzle body 54, fluidly connecting nozzle passage 76 to nozzle outlets 60 when main-flow seat 82 is open.

As noted above, timing control piece 66 is in contact with rate-control piece 68 at a radially inward seating location 81 at the advanced position of timing control piece 66. Rate control piece 68 is in contact with inner nozzle surface 64, namely, in contact with main-flow seat 82, at a radially outward seating location 83 at the advanced position of rate control piece 68. Rate control piece 68 may further include a first seating edge 84 in contact with main-flow seat 82 at radially outward seating location 81, defining a circular seating line extending circumferentially around longitudinal axis 56. Also in the illustrated embodiment, timing control piece 66 forms a starting-flow seat 86, and rate control piece 68 includes a second seating edge 88 in contact with starting-flow seat 86 at radially inward seating location 83 and defining a second circular seating line radially inward of the first seating line and extending circumferentially around longitudinal axis 56. Thus, timing control piece 66 is understood to form a seat, contacted by a seating edge of rate control piece 68. In an alternative embodiment, a seat could be formed by rate control piece 68, and a seating edge formed on timing control piece 66, essentially the reverse of the illustrated embodiment. It is also contemplated that main-flow seat 82 and seating edge 84 could be reversely configured, with a seating edge formed on nozzle body 54 and a counterpart seat formed on rate control piece 68. Main-flow seat 82 and starting-flow seat 86 may be conical seats, however, the present disclosure is not thereby limited, and other seat configurations such as a spherical seat configuration could be used for one or both, in some embodiments.

As also illustrated in FIG. 3, timing control piece 66 includes a first peripheral wall surface 90 extending circumferentially around longitudinal axis 56, and rate control piece 68 includes a second peripheral wall surface 92 extending circumferentially around longitudinal axis 56. Starting-flow clearance 80 extends radially between first peripheral wall surface 90, and second peripheral wall surface 92. Timing control piece 66 includes an axially extending guide projection 94. In the illustrated embodiment, first peripheral wall surface 90 includes an inner peripheral wall surface of axially extending guide projection 94, and second peripheral wall surface 92 includes an outer peripheral wall surface.

Figure 6:
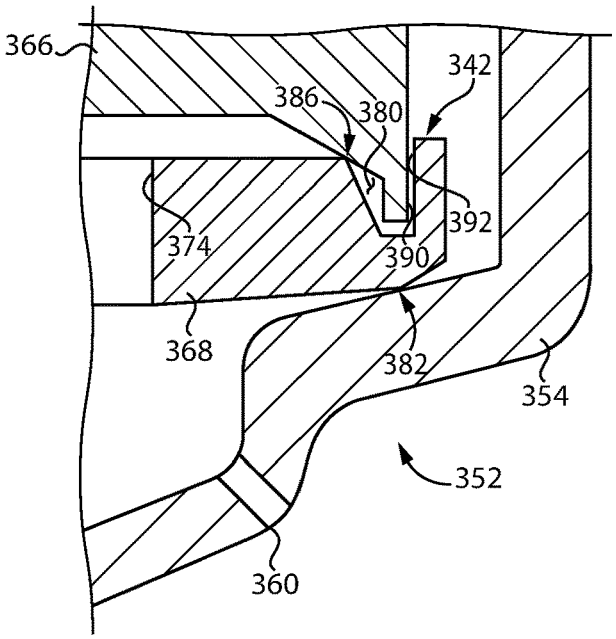
FIG. 6 is a sectioned side diagrammatic view of a fuel injector nozzle assembly, according to one embodiment.

Referring to FIG. 6, there is shown an alternative embodiment of a nozzle assembly 352 having similarities with nozzle 52, but certain differences. Nozzle assembly 352 includes a nozzle body 354 having a plurality of nozzle outlets 60 (one shown) formed therein, and a two-piece outlet check 342 within nozzle body 354 and including a timing control piece 366 and a rate control piece 368 having a through-hole 374. Timing control piece 366 and rate control piece 368, and other components of nozzle assembly 352, may be functionally analogous to the foregoing embodiments, and except where otherwise indicated or apparent from the context description herein of features and functionality of any one embodiment can be understood to refer by way of analogy to any other embodiment. Nozzle body 354 forms a main flow seat 382 that is sealed by a seating edge on rate control piece 368 at an advanced position, although the arrangement could be reversed such that a main flow seat is formed by rate control piece 368 and a seating edge formed by nozzle body 354. Timing control piece 366 forms a starting-flow seat 386 that is sealed by a seating edge on rate control piece 368, although again the arrangement as to which part forms the seat and which part forms the seating edge could be reversed. A starting-flow clearance 380 extends between timing control piece 366 and rate control piece 368. Rate control piece 368 includes an inner peripheral wall surface 392, and timing control piece includes an outer peripheral wall surface 390, with starting-flow clearance 380 extending between inner peripheral wall surface 392 and outer peripheral wall surface 390. Those skilled in the art will appreciate a variety of different alternatives as to which of two pieces in a two-piece outlet check includes a starting-flow seat and which of the two pieces includes a cooperating seating edge, and which of the two pieces includes a guide projection, for instance.

Returning to FIG. 3 nozzle assembly 52 is shown as it might appear where both timing control piece 66 and rate control piece 68 are at advanced positions. It will be appreciated that travel distances of timing control piece 66 and rate control piece 68 between their respective advanced and retracted positions may be relatively small. Timing control piece 66 has an axial lift distance 96 between the respective advanced position and retracted position, and starting-flow clearance 80 defines an axial leakage distance 98, between first peripheral wall surface 90 and second peripheral wall surface 92, that is greater than axial lift distance 96. Axial leakage distance 98 might be about one millimeter larger than axial lift distance 96 in some embodiments although the present disclosure is not thereby limited.

A clearance distance 99 between first peripheral wall surface 90 and second peripheral wall surface 92 is also shown in FIG. 3. In one implementation clearance distance 99 might be about three orders of magnitude smaller than a guide diameter defined by first peripheral wall surface 90, for example clearance distance 99 might be about 0.030 millimeters or 30 microns for a 2.7 millimeter guide diameter. Although alternative clearance sizes are contemplated, and further discussed herein, it is contemplated that a clearance distance of approximately this relative size can provide a pressure drop through starting-flow clearance 80 that assists in lifting off rate control piece 68 from its advanced position shortly after timing control piece 66 is retracted. It will also be recalled that seating contact between rate control piece 68 and nozzle body 54 occurs at radially outward seating location 81, and that seating contact between timing control piece 66 and rate control piece 68 occurs at radially inward seating location 83. It is desirable, in at least some embodiments, for the seating diameter between timing control piece 66 and rate control piece 68 to be smaller than the seating diameter between rate control piece 68 and nozzle body 54 to assist in timing control piece 66 lifting first to open starting-flow clearance 80 prior to opening main-flow seat 82.

It can further be appreciated that embodiments described herein, and others contemplated, can have certain features of symmetry, shape, proportion, and geometry generally, that provide practical implementations with respect to manufacturability. In the case of rate control piece 68 tip facing axial side 70 may be radially symmetric about longitudinal axis 56, and includes a lower surface 73 that is circumferentially uniform about longitudinal axis 56 and about through-hole 74. Opposite axial side 72 may also be radially symmetric about longitudinal axis 56, and includes an upper surface 75 that is circumferentially uniform about longitudinal axis 56 and about through-hole 74. Lower surface 73 may be conical, as illustrated, but in some embodiments could be another shape such as planar, for example. Upper surface 75 may be planar, as illustrated, but in some embodiments could be another shape such as conical, for example. Lower surface 73 and upper surface 75 could each be planar or each be conical and, in the case of either, rate control piece 68 could be axially symmetric (upper to lower in FIG. 3) at least radially inward of seating line 83, with surfaces 73 and 75 being parallel or defining oppositely oriented cones or hemispheres, for instance. Peripheral surface 92 may be uniformly cylindrical circumferentially around axis 56. Radially outward surfaces (not numbered) extending radially from seating edges 88 and 84 to peripheral surface 92 may also be conical. In the illustrated embodiment, and others contemplated herein, lower surface 73 and upper surface 75 may have uniform profiles of rotation circumferentially around longitudinal axis 56, and thus rate control piece 68 may have a uniform profile of rotation circumferentially around longitudinal axis 56. These features are contemplated to facilitate machining rate control piece 68 to specified shapes and dimensions within standard or tighter than standard manufacturing tolerances. In the case of rate control piece 368, peripheral surface 392 may be uniformly cylindrical, and upper and lower surfaces (not numbered) extending circumferentially around through-bore 374 may also be planar, conical, axially symmetric, or various alternatives generally analogous to the structures described with regard to rate control piece 68. It will be recalled that in the case of either embodiment the "through-hole" could be a plurality of holes, of any suitable shape, extending axially through the respective rate control piece.

Figure 4:
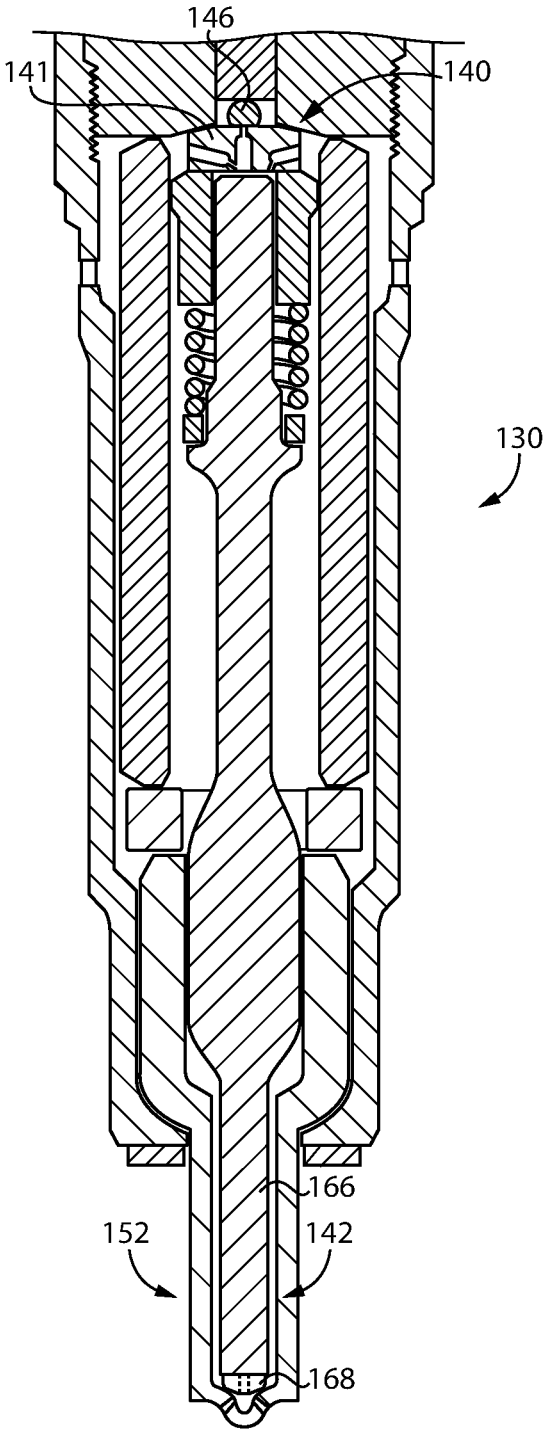
FIG. 4 is a sectioned side diagrammatic view of a fuel injector, according to one embodiment.

Referring briefly to FIG. 4, there is shown a fuel injector 130 according to another embodiment, and including a two-piece outlet check 142 in a fuel injector nozzle assembly 152 having a timing control piece 166 and a rate control piece 168. Fuel injector 130 differs from fuel injector 30 mainly in relation to the manner in which two-piece outlet check 142 is actuated. Namely, fuel injector 130 may include an injection control valve assembly 140 having a two-way valve 146 positioned in seated contact with a valve seat orifice plate 141. When control valve assembly 140 is energized, control valve 146 can move, upward in the FIG. 4 illustration, to reduce a closing hydraulic pressure on timing control piece 166 via a pressure reduction provided through an orifice in valve seat orifice plate 141. When injection control valve assembly 140 is deenergized, control valve 146 will return to a seated location in sealing contact with valve seat orifice plate 141, and enabling closing hydraulic pressure on timing control piece 166 to be restored through one or more other orifices in valve seat orifice plate 141.

INDUSTRIAL APPLICABILITY

Referring to the drawings generally, but also returning to FIGS. 2 and 3, when it is desirable to initiate a fuel injection event, control valve assembly 46 can be energized to reduce hydraulic pressure in control chamber 59, causing timing control piece 66 to begin to move toward a retracted position based upon high pressure of fuel acting upon opening hydraulic surface 57 and/or other opening hydraulic surfaces on timing control piece 66. Retracting timing control piece 66 will cause timing control piece 66 and rate control piece 68 to separate from contact, opening starting-flow clearance 80 based on the retracting of timing control piece 66. A starting flow of fuel is then conveyed through starting-flow clearance 80 to nozzle outlets 60 to start a spray of fuel from fuel injector 30 into an associated combustion cylinder 16.

As the initial, relatively small and slow starting flow of fuel is spraying from fuel injector 30, opening hydraulic pressures acting upon rate control piece 68 will cause rate control piece 68 to begin retracting, after initiating the retracting of timing control piece 66, and opening main-flow seat 82. A main flow of fuel through the now open main-flow seat 82 is conveyed to nozzle outlet 60 to continue the spray of the fuel from fuel injector 30. The starting of the spray of fuel, based upon opening starting-flow clearance 80, may include starting the spray of fuel at a slower injection rate, and the continuing of the spray of fuel subsequently through open main-flow seat 82 may include continuing the spray of fuel at a faster injection rate. As rate control piece 68 begins to move it will thus open main-flow seat 82 and then typically close starting-flow clearance 80 when rate control piece 68 reaches its advanced position.

In some instances, a tiny injection of fuel might be injected with little or no flow through main-flow seat 82 at all, by rapidly returning timing control piece 66 to its advanced position after initially retracting to opening starting-flow clearance 80. This feature is contemplated to provide minimum delivery advantages over certain known systems. The timing of when rate control piece 68 begins to move can vary depending upon factors such as the sizing of starting-flow clearance 80, and relative diameters defined by radially outward seating location 81 and radially inward seating location 83, and area scheduling through starting-flow clearance 80 and main-flow seat 82. In one embodiment, radially outward seating location 81 might define a seating diameter of about 2.3 millimeters, and radially inward seating location 83 might define a seating diameter of about 2.1 millimeters. A relatively larger size diameter of through-hole 74 may be desirable if starting-flow clearance 80 is to stay open longer, for example, to provide a relatively longer-duration slow initial fuel injection.

Figure 5:
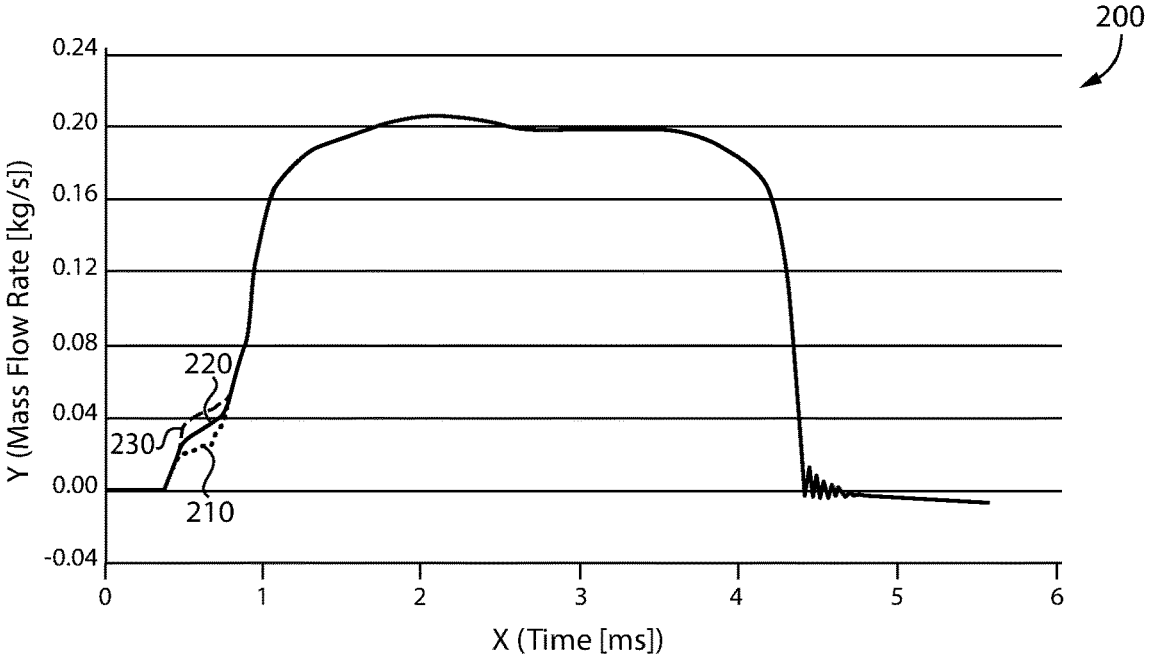
FIG. 5 is a graph showing fuel injector sac pressures for different nozzle assembly constructions.

Referring now to FIG. 5, there is shown a graph 200 with time in milliseconds on the X-axis, and mass flow rate through injector tip orifices in kilograms per second (Kg/s) on the Y-axis for fuel injectors according to the present disclosure. Graph 200 shows a trace 210 that might be observed during a fuel injection for a fuel injector having a two-piece outlet check with a smaller starting-flow clearance, a trace 220 that might be observed during a fuel injection for a fuel injector having a two-piece outlet check with a medium starting-flow clearance, and a trace 230 that might be observed during a fuel injection for a fuel injector having a two-piece outlet check with a larger starting-flow clearance. The smaller starting-flow clearance is about 0.020 millimeters or 20 microns, the medium starting-flow clearance is about 0.025 millimeters or 25 microns, and the larger starting-flow clearance is about 0.030 millimeters or 30 microns.

Traces 210, 220, 230 can be understood in the examples to show similar incipient fuel flow rates, commencing just prior to about 0.5 milliseconds, and similar continuing fuel flow rates starting at about 0.75 milliseconds, but differ in fuel flow rates/rate shapes between about 0.5 milliseconds and about 0.75 milliseconds due to the different relative sizes of the starting-flow clearances. The smaller starting-flow clearance of the two-piece outlet check associated with trace 210 can be understood to be relatively more restrictive to initial fuel flow between a timing control piece and a rate control piece while the timing control piece begins retracting, relative to the medium starting-flow clearance between a timing control piece and a rate control piece of trace 220, which is in turn relatively more restrictive to initial fuel flow between its timing control piece and rate control piece. A front-end ramp in the rate shape of trace 210 provides a relatively smaller flow, in the case of trace 220 a medium flow, and the in the case of 230 a relatively greater flow. It will thus be appreciated that by varying a size of the starting-flow clearance in a two-piece outlet check, such as a starting-flow clearance extending radially peripherally between a timing control piece and a rate control piece, different starting flow rates can be obtained for various ends. Still further variations can be obtained by varying a relative size of a through-hole in a rate control piece. For instance, as suggested above a relatively larger or smaller size of a through-hole in a rate control piece can be used to adjust a duration of a relatively slow initial component of fuel injection rate. Thus, in the examples of FIG. 5, making any of the through-holes in the respective rate control pieces relatively larger in diameter could be expected to lengthen a duration of the front-end ramps in injection rate that are observed for each of traces 210, 220, 230, and making any of the through-holes in the respective rate control pieces relatively smaller in diameter could be expected to shorten a duration of the front-end ramps in injection rate.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A fuel injector comprising:

a nozzle body defining a longitudinal axis, and having nozzle outlets formed therein each extending between an outer nozzle surface and an inner nozzle surface;

a two-piece outlet check including a timing control piece, and a rate control piece trapped between the timing control piece and the nozzle body, and having a through-hole formed therein fluidly connected to the nozzle outlets;

a nozzle passage is formed between the nozzle body and the two-piece outlet check;

a starting-flow clearance is formed by the rate control piece and the timing control piece and extends between the nozzle passage and the through-hole;

the timing control piece is movable from an advanced position in contact with the rate control piece and blocking the starting-flow clearance, to a retracted position, relative to the rate control piece, where the starting-flow clearance is open; and the rate control piece is movable, relative to the nozzle body and based on a position of the timing control piece, from an advanced position in contact with the inner nozzle surface, to a retracted position where a main-flow injection path is formed between the rate control piece and the nozzle body and fluidly connects the nozzle passage to the nozzle outlets.

2. The fuel injector of claim 1 wherein:

the timing control piece is in contact with the rate control piece at a radially inward seating location at the advanced position of the timing control piece; and the rate control piece is in contact with the inner nozzle surface at a radially outward seating location at the advanced position of the rate control piece.

3. The fuel injector of claim 2 wherein the inner nozzle surface forms a main-flow seat, and the rate control piece includes a seating edge in contact with the main-flow seat at the radially outward seating location and defining a seating line extending circumferentially around the longitudinal axis.

4. The fuel injector of claim 3 wherein the timing control piece forms a starting-flow seat, and the rate control piece includes a second seating edge in contact with the starting-flow seat at the radially inward seating location and defining a second seating line radially inward of the first seating line and extending circumferentially around the longitudinal axis.

5. The fuel injector of claim 1 wherein:

the timing control piece includes a first peripheral wall surface extending circumferentially around the longitudinal axis;

the rate control piece includes a second peripheral wall surface extending circumferentially around the longitudinal axis; and the starting-flow clearance extends radially between the first peripheral wall surface and the second peripheral wall surface.

6. The fuel injector of claim 5 wherein the first peripheral wall surface is an inner peripheral wall surface, and the second peripheral wall surface is an outer peripheral wall surface.

7. The fuel injector of claim 1 wherein:

the timing control piece includes a first axial end having a closing hydraulic surface formed thereon, and a second axial end in contact with the rate control piece at the advanced position of the timing control piece; and the second axial end has an opening hydraulic surface formed thereon and exposed to a fluid pressure of the nozzle passage.

8. The fuel injector of claim 7 wherein:

the timing control piece defines a longer axial length dimension extending between the first axial end and the second axial end; and the rate control piece includes a tip-facing axial side, and an opposite axial side, and defines a shorter axial length dimension extending between the tip-facing axial side and the opposite axial side.

9. The fuel injector of claim 8 wherein:

the tip-facing axial side includes a lower surface, and the opposite axial side includes an upper surface;

each of the lower surface and the upper surface has a uniform profile of rotation circumferentially around the longitudinal axis; and the rate control piece further includes a peripheral surface that is uniformly cylindrical circumferentially around the longitudinal axis.

10. A fuel injector nozzle assembly comprising:

a nozzle body defining a longitudinal axis, and including a nozzle tip having nozzle outlets formed therein each extending between an outer nozzle surface and an inner nozzle surface;

a two-piece outlet check positioned at least partially within the nozzle body and including a timing control piece, and a rate control piece trapped between the timing control piece and the nozzle body and having a tip-facing axial side, an opposite axial side, and a through-hole extending between the tip-facing axial side and the opposite axial side;

a nozzle passage is formed between the nozzle body and the two-piece outlet check;

a sac cavity is formed by the rate control piece and the nozzle body and fluidly connects the through-hole to the nozzle outlets;

a starting-flow clearance is formed by the rate control piece and the timing control piece and extends between the nozzle passage and the through-hole;

the timing control piece is movable from an advanced position in contact with the rate control piece and blocking the starting-flow clearance at a radially inward seating location, to a retracted position, relative to the rate control piece, where the starting-flow clearance is open; and the inner nozzle surface forms a main-flow seat, and the rate control piece is movable, relative to the nozzle body and based on a position of the timing control piece, from an advanced position in contact with the inner nozzle surface at a radially outward seating location and blocking the main-flow seat, to a retracted position where the main-flow seat is open.

11. The nozzle assembly of claim 10 wherein the rate control piece includes a seating edge in contact with the main-flow seat at the radially outward seating location and defining a seating line extending circumferentially around the longitudinal axis.

12. The nozzle assembly of claim 11 wherein the timing control piece forms a starting-flow seat, and the rate control piece includes a second seating edge in contact with the starting-flow seat at the radially inward seating location and defining a second seating line radially inward of the first seating line and extending circumferentially around the longitudinal axis.

13. The nozzle assembly of claim 10 wherein:

the timing control piece includes a first peripheral wall surface extending circumferentially around the longitudinal axis;

the rate control piece includes a second peripheral wall surface extending circumferentially around the longitudinal axis; and the starting-flow clearance extends radially between the first peripheral wall surface and the second peripheral wall surface.

14. The nozzle assembly of claim 13 wherein the timing control piece includes an axially extending guide projection and the first peripheral wall surface includes an inner peripheral wall surface of the axially extending guide projection.

15. The nozzle assembly of claim 10 wherein the timing control piece has an axial lift distance between the respective advanced position and retracted position, and the starting-flow clearance defines an axial leakage distance that is greater than the axial lift distance.

16. The nozzle assembly of claim 10 wherein:

the timing control piece defines a longer axial length dimension, and the rate control piece defines a shorter axial length dimension; and the tip-facing axial side is radially symmetric about the longitudinal axis, and the opposite axial side is radially symmetric about the longitudinal axis.

17. A method of operating a fuel injector for an internal combustion engine comprising:

retracting a timing control piece in a two-piece outlet check in a fuel injector;

opening a starting-flow clearance formed between the timing control piece and a rate control piece of the two-piece outlet check;

conveying a starting-flow of fuel through the starting-flow clearance to nozzle outlets in the fuel injector to start a spray of fuel from the fuel injector;

retracting the rate control piece after initiating the retracting of the timing control piece to open a main-flow seat; and conveying a main flow of the fuel through the main-flow seat to the nozzle outlets to continue the spray of fuel from the fuel injector.

18. The method of claim 17 wherein the starting of the spray of fuel from the fuel injector includes starting the spray of fuel at a slower injection rate, and the conveying of the spray of fuel includes continuing the spray of fuel at a faster injection rate.

19. The method of claim 17 wherein the conveying of the starting-flow of fuel further includes conveying the starting-flow of fuel through the rate control piece.

20. The method of claim 17 wherein the opening of the starting-flow clearance further includes opening a starting-flow seat that is radially inward of the main-flow seat.

* * * * *